US008054275B2

(12) United States Patent
Yamato et al.

(10) Patent No.: US 8,054,275 B2
(45) Date of Patent: Nov. 8, 2011

(54) LIQUID CRYSTAL DRIVING CIRCUIT AND METHOD WITH CORRECTION COEFFICIENTS BASED ON CURRENT AND PREVIOUS FRAME GRADATION RANGES

(75) Inventors: Asahi Yamato, Tokyo (JP); Kohji Saitoh, Tokorozawa (JP); Akizumi Fujioka, Tokyo (JP); Keiichi Yamamoto, Tenri (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 344 days.

(21) Appl. No.: 12/309,489

(22) PCT Filed: Jun. 6, 2007

(86) PCT No.: PCT/JP2007/061416

§ 371 (c)(1), (2), (4) Date: Jan. 21, 2009

(87) PCT Pub. No.: WO2008/032480

PCT Pub. Date: Mar. 20, 2008

(65) Prior Publication Data

US 2009/0207163 A1 Aug. 20, 2009

(30) Foreign Application Priority Data

Sep. 12, 2006 (JP) ..... 2006-247308

(51) Int. Cl.
*G09G 3/36* (2006.01)

(52) U.S. Cl. ..... 345/96

(58) Field of Classification Search ..... 345/87–104, 345/204, 690, 209, 54, 215
See application file for complete search history.

(56) References Cited

U.S. PATENT DOCUMENTS

| | | | | |
|---|---|---|---|---|
| 6,331,844 | B1 * | 12/2001 | Okumura et al. | 345/87 |
| 7,528,850 | B2 * | 5/2009 | Ham | 345/690 |
| 2001/0038372 | A1 | 11/2001 | Lee | |
| 2002/0044126 | A1 | 4/2002 | Aoki | |
| 2003/0043165 | A1 * | 3/2003 | Miyachi et al. | 345/589 |
| 2003/0122854 | A1 * | 7/2003 | Ooishi et al. | 345/690 |

(Continued)

FOREIGN PATENT DOCUMENTS

JP 02-184891 7/1990

(Continued)

*Primary Examiner* — Amr Awad
*Assistant Examiner* — Liliana Cerullo
(74) *Attorney, Agent, or Firm* — Harness, Dickey & Pierce, P.L.C.

(57) ABSTRACT

In one embodiment of the present application, a memory stores a lookup table storing, in accordance with a combination of a value of a video signal of a current frame and a value of a video signal of a previous frame, each of correction values, the correction values in each of which a temporal change of a video signal is enhanced. A correcting circuit carries out, with respect to a correction value selected from the lookup table, a predetermined correcting operation in accordance with a polarity of a voltage to be applied to each of data signal lines S1 through Sm, with the use of a correction coefficient which is set based on properties of liquid crystal. Thus found is a corrected video signal in accordance with a positive or negative polarity. This makes it possible to find, with less memory capacity, an optimum corrected video signal in accordance with a polarity of a voltage to be applied to a data signal line.

15 Claims, 6 Drawing Sheets

U.S. PATENT DOCUMENTS

| | | | | |
|---|---|---|---|---|
| 2004/0125064 | A1* | 7/2004 | Adachi et al. | 345/89 |
| 2005/0088398 | A1 | 4/2005 | Lee | |
| 2006/0274007 | A1 | 12/2006 | Lee | |
| 2008/0191986 | A1 | 8/2008 | Lee | |
| 2009/0267884 | A1* | 10/2009 | Takahashi et al. | 345/96 |

FOREIGN PATENT DOCUMENTS

| | | |
|---|---|---|
| JP | 03-126069 | 5/1991 |
| JP | 09-081083 | 3/1997 |
| JP | 2001-265298 | 9/2001 |
| JP | 2002-182622 | 6/2002 |

* cited by examiner

FIG.2

(a)

| | | GRADATION OF CURRENT FRAME | | | | | | | | |
|---|---|---|---|---|---|---|---|---|---|---|
| | | 0 | 32 | 64 | 96 | 128 | 160 | 192 | 224 | 255 |
| GRADATION OF PREVIOUS FRAME | 0 | 0 | 90 | | | 195 | | | | 255 |
| | 32 | 0 | 32 | | | | | | | |
| | 64 | | | 64 | | | | | | |
| | 96 | | | | 96 | 140 | | | | |
| | 128 | 0 | | | 79 | 128 | 170 | | | 255 |
| | 160 | | | | | 113 | 160 | | | |
| | 192 | | | | | | | 192 | | |
| | 224 | | | | | | | | 224 | 255 |
| | 255 | 0 | | | | 54 | | | 217 | 255 |

(b)

| | | GRADATION OF CURRENT FRAME | | | | | | | | |
|---|---|---|---|---|---|---|---|---|---|---|
| | | 0 | 32 | 64 | 96 | 128 | 160 | 192 | 224 | 255 |
| GRADATION OF PREVIOUS FRAME | 0 | 0 | 63 | | | 150 | | | | 250 |
| | 32 | 3 | 32 | | | | | | | |
| | 64 | | | 64 | | | | | | |
| | 96 | | | | 96 | 133 | | | | 253 |
| | 128 | 3 | | | 90 | 128 | 165 | | | |
| | 160 | | | | | 122 | 160 | | | |
| | 192 | | | | | | | 193 | | |
| | 224 | | | | | | | | 224 | 255 |
| | 255 | 4 | | | | 103 | | | 223 | 255 |

FIG.3

| | | GRADATION OF CURRENT FRAME | | | | | | | | |
|---|---|---|---|---|---|---|---|---|---|---|
| | | 0 | 32 | 64 | 96 | 128 | 160 | 192 | 224 | 255 |
| GRADATION OF PREVIOUS FRAME | 0 | 0 | 76 | | | 172 | | | | 255 |
| | 32 | 0 | 32 | | | | | | | |
| | 64 | | | 64 | | | | | | |
| | 96 | | | | 96 | 136 | | | | |
| | 128 | 0 | | | 85 | 128 | 167 | | | 255 |
| | 160 | | | | | 118 | 160 | | | |
| | 192 | | | | | | | 192 | | |
| | 224 | | | | | | | | 224 | 255 |
| | 255 | 0 | | | | 82 | | | 220 | 255 |

FIG.4

| | | REFERENCE GRADATION RANGE | | |
|---|---|---|---|---|
| | | 1 | 2 | 3 |
| PREVIOUS FRAME GRADATION RANGE | 1 | 1.0 | 2.1 | 0.3 |
| | 2 | 0.1 | 0.5 | 0.5 |
| | 3 | 0.1 | 1.0 | 1.0 |

FIG.5

(a)

| | | GRADATION OF CURRENT FRAME | | | | | | | | |
|---|---|---|---|---|---|---|---|---|---|---|
| | | 0 | 32 | 64 | 96 | 128 | 160 | 192 | 224 | 255 |
| GRADATION OF PREVIOUS FRAME | 0 | 0 | 87 | | | 197 | | | | 255 |
| | 32 | 0 | 32 | | | | | | | |
| | 64 | | | 64 | | | | | | |
| | 96 | | | | 96 | 137 | | | | |
| | 128 | 0 | | | 82 | 128 | 168 | | | 255 |
| | 160 | | | | | 115 | 160 | | | |
| | 192 | | | | | | | 192 | | |
| | 224 | | | | | | | | 224 | 255 |
| | 255 | 0 | | | | 58 | | | 215 | 255 |

(b)

| | | GRADATION OF CURRENT FRAME | | | | | | | | |
|---|---|---|---|---|---|---|---|---|---|---|
| | | 0 | 32 | 64 | 96 | 128 | 160 | 192 | 224 | 255 |
| GRADATION OF PREVIOUS FRAME | 0 | 0 | 65 | | | 147 | | | | 250 |
| | 32 | 4 | 32 | | | | | | | |
| | 64 | | | 64 | | | | | | |
| | 96 | | | | 96 | 135 | | | | 249 |
| | 128 | 2 | | | 88 | 128 | 166 | | | |
| | 160 | | | | | 121 | 160 | | | |
| | 192 | | | | | | | 193 | | |
| | 224 | | | | | | | | 224 | 253 |
| | 255 | 4 | | | | 106 | | | 225 | 255 |

FIG.6

(a)

| | | REFERENCE GRADATION RANGE | | |
|---|---|---|---|---|
| | | 1 | 2 | 3 |
| PREVIOUS FRAME GRADATION RANGE | 1 | A | B | C |
| | 2 | D | E | F |
| | 3 | G | H | I |

(b)

| | | REFERENCE GRADATION RANGE | | |
|---|---|---|---|---|
| | | 1 | 2 | 3 |
| PREVIOUS FRAME GRADATION RANGE | 1 | A / A' | B | C |
| | 2 | D | E / E' | F |
| | 3 | G | H | I / I' |

LIQUID CRYSTAL DRIVING CIRCUIT AND METHOD WITH CORRECTION COEFFICIENTS BASED ON CURRENT AND PREVIOUS FRAME GRADATION RANGES

TECHNICAL FIELD

The present invention relates to a liquid crystal driving circuit, a driving method, and a liquid crystal display apparatus, in each of which line-reversal driving or frame-reversal driving is carried out.

BACKGROUND ART

In a liquid crystal display apparatus, a driving method is adopted in which a voltage to be applied to a pixel reverses in polarity at regular time intervals. This is because a problem such as screen burn-in can occur, if a voltage having a same polarity is continuously applied to a pixel. Examples of such a driving method encompass frame-reversal driving in which an applied voltage reverses in polarity frame by frame, line-reversal driving in which an applied voltage reverses in polarity line by line or every several lines, and dot-reversal driving in which an applied voltage reverses in polarity pixel by pixel. In some liquid crystal display apparatuses, overshoot driving (also referred to as overdrive or overdrive driving) is adopted so that a response speed is improved. According to the overshoot driving, a voltage, which is higher or lower than a voltage supposed to be applied, is applied to a pixel in accordance with (i) a video signal of a current frame and (ii) a video signal of a previous frame. Overshoot driving is disclosed in, for example, Patent Document 1.

[Patent Document 1]

Japanese Unexamined Patent Publication No. 2001-265298 (Tokukai 2001-265298, date of publication: Sep. 28, 2001)

DISCLOSURE OF INVENTION

Unfortunately, a conventional liquid crystal display apparatus in which the line-reversal driving is adopted has a problem that bright and dark stripes appear on a display screen while a moving image is being displayed based on the fact that an applied voltage reverses in polarity line by line. This is because a pixel to which a voltage having a positive polarity is applied and a pixel to which a voltage having a negative polarity is applied are different in an amount of change in brightness of pixels.

The reason for this is as below. Namely, in a liquid crystal display apparatus, a voltage externally supplied to a pixel decreases in the pixel due to pull-in. In a general liquid crystal display apparatus, the closer to zero an applied voltage is, the larger the amount of pull-in (the amount of voltage reduced due to the pull-in).

As such, it is necessary to add to an applied voltage the amount of pull-in, which varies according to a level of the applied voltage, when a voltage to be actually applied is determined. For example, in case of a normally-black type liquid crystal display apparatus, it is necessary to add a large amount of pull-in to an applied voltage when the applied voltage has a small absolute value and a pixel is dark, whereas it is necessary to add a small amount of pull-in to an applied voltage when the applied voltage has a large absolute value and a pixel is bright.

The foregoing unevenness of change in brightness of pixels and the bright and dark stripes due to the unevenness are caused independently of whether or not the overshoot driving is carried out, and are especially high in a case where overshoot driving is carried out.

For the prevention of the bright and dark stripes, it is possible to present a method in which two different lookup tables are distinctively used in accordance with a polarity of an applied voltage. Specifically, according to the method, (i) a correction value is selected, as a corrected video signal, from a lookup table in accordance with a polarity of a voltage to be applied to a data signal line, and (ii) a voltage is applied to the data signal line in accordance with the corrected video signal.

Unfortunately, employment of the method leads to a new problem that memory capacity increases because two lookup tables are required.

In view of the problem, the present invention was made, and an object of the present invention is to provide a liquid crystal driving circuit, a driving method, and a liquid crystal display apparatus, each of which makes it possible to find, with less memory capacity, an optimum corrected video signal in accordance with a polarity of a voltage to be applied to a data signal line.

(Liquid Crystal Driving Circuit)

In order to attain the object, a liquid crystal driving circuit of the present invention is a liquid crystal driving circuit that (i) finds a corrected video signal by carrying out, with respect to each of video signals supplied from a signal source, a correction in which a temporal change in each of the video signals is enhanced, and (ii) causes a voltage which varies in accordance with the corrected video signal to reverse in polarity at every predetermined reference unit, and (iii) applies the voltage to a data signal line, said liquid crystal driving circuit including: a memory for storing a table, the table storing, in accordance with combinations of values of the video signals, correction values, respectively, the correction values in which the temporal changes of the video signals are enhanced; and a correcting circuit for finding the corrected video signal by carrying out, with respect to a correction value selected from the table, a predetermined correcting operation in accordance with the polarity of the voltage, with the use of a correction coefficient which is set based on properties of liquid crystal.

According to the arrangement, the liquid crystal driving circuit finds a corrected video signal, by carrying out a correction for enhancing a temporal change of the video signal with respect to a video signal supplied from the signal source. A voltage, which varies depending on the corrected video signal thus found, reverses in polarity at every predetermined reference unit, for example, for every frame or for every line. Then, the voltage is applied to a data signal line. That is, liquid crystal is driven by reversal driving. The correction makes it possible to perform overshoot driving.

The memory in the liquid crystal driving circuit stores the table storing, in accordance with combinations of values of the video signals, correction values, respectively, in which correction values temporal changes of video signals are enhanced. The table stores, for example, correction values which are set in accordance with combinations of a value of a video signal of a previous frame and a value of a video signal of a current frame.

In the liquid crystal driving circuit, the correcting circuit finds a corrected video signal by carrying out, with respect to a correction value stored in the table, a correcting operation in accordance with a polarity of a voltage. That is, a correction value is initially selected from the table, independently of a polarity of a voltage.

Then, the correcting circuit finds a corrected video signal by carrying out, with respect to the correction value selected from the table, the predetermined correcting operation in accordance with a polarity of a voltage, with the use of a correction coefficient which is set based on properties of liquid crystal. The correction coefficient can be a single common coefficient, or, alternatively, a value which varies depending on a value of a video signal.

In a case where an applied voltage has the positive polarity, the correcting circuit carries out, with respect to a correction value selected from the table, a correcting operation in accordance with the positive polarity, with the use of a correction coefficient. The correcting circuit thus finds a corrected video signal having a value suitable for the positive polarity. In contrast, in a case where an applied voltage has the negative polarity, the correcting circuit carries out, with respect to a correction value selected from the table, a correcting operation in accordance with the negative polarity, with the use of a correction coefficient. The correcting circuit thus finds a corrected video signal having a value suitable for the negative polarity.

As described above, the liquid crystal driving circuit can find an optimum corrected video signal in accordance with a polarity of a voltage, without preparing two different tables in accordance with a polarity of a voltage. This makes it possible to find, with less memory capacity, an optimum corrected video signal in accordance with a polarity of a voltage to be applied to a data signal line.

(Method for Driving Liquid Crystal Driving Circuit)

In order to attain the object, a method according to the present invention for driving a liquid crystal driving circuit, in which: (i) a corrected video signal is found by carrying out, with respect to each of video signals supplied from a signal source, a correction in which a temporal change in each of the video signals is enhanced, and (ii) a voltage which varies in accordance with the corrected video signal is reversed in polarity at every predetermined reference unit, and (iii) the voltage is applied to a data signal line, said method preferably including: a selecting step of selecting the correction value from a table storing, in accordance with combinations of values of the video signals, correction values, respectively, the correction values in which the temporal changes of the video signals are enhanced; and a correcting step of finding the corrected video signal by carrying out, with respect to a correction value selected from the table, a predetermined correcting operation in accordance with the polarity of the voltage, with the use of a correction coefficient which is set based on properties of liquid crystal.

According to the arrangement, it is possible to realize the same functions and effects as those realized by the liquid crystal driving circuit of the present invention.

(One Example of Calculation of Corrected Video Signal)

In the liquid crystal driving circuit of the present invention, it is preferable that the correcting circuit finds a value of the corrected video signal obtained in a case where the voltage has the positive polarity, by adding a product of (i) the correction coefficient and (ii) a value found by subtracting a value of a video signal of a previous frame from the correction value to the value of the video signal of the previous frame.

According to the arrangement, a decrease in voltage in each of the pixels caused due to the pull-in in the case of the positive polarity becomes close to a decrease in voltage in each of the pixels generated due to the pull-in in the case of the negative polarity. This makes it possible to suppress unevenness of brightness of the pixels, thereby improving the quality of image display. For example, this makes it possible to prevent stripes from being displayed when the line-reversal driving is carried out.

(Another Example of Calculation of Corrected Video Signal)

In the liquid crystal driving circuit of the present invention, it is preferable that the correcting circuit finds a value of the corrected video signal obtained in a case where the voltage has the negative polarity, by subtracting, from a value of video signal of a previous frame, a product of (i) the correction coefficient and (ii) a, value found by subtracting the value of the video signal of the previous frame from the correction value.

According to the arrangement, a decrease in voltage in each of the pixels generated due to the pull-in in the case of the negative polarity becomes close to a decrease in voltage in each of the pixels generated due to the pull-in in the case of the positive polarity. This makes it possible to suppress unevenness of brightness of the pixels, thereby improving the quality of image display. For example, this makes it possible to prevent stripes from being displayed when the line-reversal driving is carried out.

(Specific Correction Coefficient)

In the liquid crystal driving circuit of the present invention, it is preferable that the correction coefficients are set, in advance, in accordance with a video signal of a previous frame and the correction value; and the correcting circuit uses in the correcting operation the correction coefficient which is set in accordance with the video signal of the previous frame and the correction value.

According to the arrangement, correction coefficients are set, in advance, in accordance with a video signal of a previous frame and the correction value selected from the table. The correcting circuit selects a correction coefficient in accordance with a value of a video signal of a previous frame and a correction value selected from the table and uses the selected correction coefficient in the correcting operation for finding a value of a corrected video signal.

This makes it possible to use a specific correction coefficient for every combination of a value of a video signal of a previous frame and a correction value selected from the table. As a result, it is possible to improve the quality of image display more finely.

(Correction Coefficient in Accordance with Range of Correction Values)

In the liquid crystal driving circuit of the present invention, it is preferable that the correction coefficient is set in accordance with (i) a range in which values of video signals of a previous frame fall and (ii) a range in which the correction values fall.

According to the arrangement, a correction coefficient is set in accordance with (i) a range in which a value of a video signal of a previous frame falls and (ii) a range in which the correction value falls. For example, in a case where a value of a video signal is in a range from 0 to 255, such a range is set so as to be divided into first through fourth ranges. In this case, for example, out of values of 0 to 255, a first range covers values from 0 to 80; a second range covers values from 81 to 120; a third range covers values from 121 to 200; a fourth range covers values from 201 to 255.

As such, in a case where a value of a video signal of a previous frame is 0 and a correction value selected from the table is 125, the correcting circuit carries out the correcting operation, which is carried out with respect to the correction value, with the use of a correction coefficient which is set in accordance with (i) the third range in which a value of a video signal of a previous frame falls and (ii) the third range in which a correction value falls.

This makes it possible to reduce the number of correction coefficients while the quality of image display is improved. As a result, this realizes a speedup of processing and a reduction in memory capacity.

(Three Divided Ranges)

In the liquid crystal driving circuit of the present invention, it is preferable that, in a case where the range in which values of the video signals fall is divided into first through third ranges in accordance with relations between the values and properties of liquid crystal, the correction coefficients are set in accordance with (i) any one of first through third ranges into which a whole range in which a value of a video signal of a previous frame falls is divided and (ii) any one of first through third ranges into which a whole range in which the correction value falls is divided.

Properties of liquid crystal, especially, a pull-in voltage in a pixel varies according to a value of a video signal. It is known that a relation between a pull-in voltage and a value of a video signal changes so as to have three phases in accordance with ranges in which values of video signals fall.

In the arrangement above, it is preferable that the correction coefficients are set in accordance with (i) any one of first through third ranges into which a whole range in which a value of a video signal of a previous frame falls is divided and (ii) any one of first through third ranges into which a whole range in which the correction value falls is divided. That is, nine correction coefficients in total are prepared in advance.

This allows a reduction in the number of necessary correction coefficients, with minimum impairment of the quality of image display.

(Details of Ranges)

In the liquid crystal driving circuit of the present invention, it is preferable that: the first range covers values from a minimum value of the video signals to a value corresponding to about 8% to 10% of a maximum value of the video signals; the second range covers values from a value larger by one than a maximum value of the first range to a value corresponding to about 90% to 92% of the maximum value of the video signals; and the third range covers values from a value larger by one than a maximum value of the second range to the maximum value of the video signals.

A pull-in voltage in a pixel varies according to ranges in which a value of a video signal falls. In a range from a minimum value of the video signals to a value corresponding to about approximately 8% to 10% of a maximum value of the video signals (i.e., in the first range), a pull-in voltage shows a uniform pace of change.

In a range from a value that is larger by one than a maximum value of the first range to a value corresponding to about 90% and 92% of the maximum value of the video signals (i.e., in the second range), a pull-in voltage shows a different pace of change from that of the first range.

In a range from a value that is larger by one than a maximum value of the second range to the maximum value of the video signals (i.e., in the third range), a pull-in voltage shows a different pace of change from those of the first range and the second range.

As such, it is possible to improve the quality of image display to the maximum extent by preparing, for every combination of ranges in which a value of a video signal falls, an optimum correction coefficient which is set based on properties of liquid crystal in each of the ranges.

(Single Correction Coefficient)

In the liquid crystal driving circuit of the present invention, further, it is preferable that the correcting circuit uses in the correcting operation a same correction coefficient independently of the values of the video signals.

According to the arrangement, the correcting circuit uses in the correcting operation a same correction coefficient independently of the values of the video signals. This makes it possible to realize the simplest circuit and to minimize a necessary memory capacity.

(Correction Coefficient in Accordance with Difference Value)

In the liquid crystal driving circuit of the present invention, it is preferable that: each of the correction coefficients is set, in advance, in accordance with a value found by subtracting a value of a video signal of a previous frame from a correction value; and the correcting circuit uses in the correcting operation a correction coefficient which is set in accordance with the value found by subtracting the value of the video signal of the previous frame from the correction value.

Physical properties of liquid crystal response greatly vary between a case where the liquid crystal changes from a bright condition to a dark condition and a case where the liquid crystal changes from a dark condition to a bright condition. The physical properties such as a pull-in amount of a voltage to be applied to an electrode greatly vary between the cases.

According to the arrangement, each of the correction coefficients is set, in advance, in accordance with a value found by subtracting a value of a video signal of a previous frame from a correction value selected from the table. As such, the correcting circuit finds a value by subtracting a value of a video signal of a previous frame from a correction value selected from the table, and uses in the correcting operation a correction coefficient which is set in accordance with the value thus found.

Such a value thus found can be an index of an amount of change in brightness. Since the correcting circuit uses a correction coefficient in accordance with an index, it is possible to reduce an effect of the amount of change in brightness on the quality of image display.

(Correction Coefficient in Accordance with Range of Difference Values)

In the liquid crystal driving circuit of the present invention, it is preferable that said each of the correction coefficients is set, in advance, in accordance with a range in which the value found by subtracting the value of the video signal of the previous frame from the correction value falls.

According to the arrangement, each of the correction coefficients is set, in advance, in accordance with a range in which the value found by subtracting a value of a video signal of a previous frame from a correction value selected from the table falls. As such, the correcting circuit finds a value by subtracting a value of a video signal of a previous frame from a correction value selected from the table, and uses in the correcting operation a correction coefficient in accordance with a range in which the value thus found falls.

This makes it possible to reduce the number of necessary correction coefficients, with a reduction of an effect of the amount of change in brightness on the quality of image display.

(Correction Coefficient in Accordance with Sign of Difference Value)

In the liquid crystal driving circuit of the present invention, it is preferable that said each of the correction coefficients is set, in advance, in accordance with a sign of the value found by subtracting the value of the video signal of the previous frame from the correction value.

According to the arrangement, each of the correction coefficients is set, in advance, in accordance with a sign of the value found by subtracting the value of the video signal of the previous frame from the correction value selected from the table. Accordingly, the correcting circuit finds a value by subtracting a value of a video signal of a previous frame from a correction value selected from the table and uses in the correcting operation a correction coefficient in accordance with a sign (plus or minus) of the value thus found.

Predominant response properties of liquid crystal are those in a case where the liquid crystal changes from a bright condition to a dark condition and in a case where the liquid crystal changes from a dark condition to a bright condition. As such, the liquid crystal driving circuit makes it possible to minimize the number of necessary correction coefficients, with a certain degree of suppression of an effect of the amount of change in brightness on the quality of image display.

(Correction Coefficient in Accordance with Polarity of Voltage)

In the liquid crystal driving circuit of the present invention, it is preferable that: each of the correction coefficients is also set, in advance, in accordance with the polarity of the voltage; and the correcting circuit uses in the correcting operation a correction coefficient in accordance with the polarity of the voltage.

Electrical characteristics (parasitic capacitance etc.) inside or outside liquid crystal greatly vary between (i) a case where a polarity of a voltage to be applied to the liquid crystal is changed from positive to negative and (ii) a case where a polarity of a voltage to be applied to the liquid crystal is changed from negative to positive. This change can affect the quality of image display.

According to the arrangement, the correcting circuit uses in the correcting operation a correction coefficient in accordance with a polarity of a voltage to be applied to liquid crystal. This makes it possible to further suppress an effect caused by a change in polarity of a voltage to be applied to the liquid crystal, thereby further improving the quality of image display.

(Second Liquid Crystal Driving Circuit)

In order to attain the object, a liquid crystal driving circuit of the present invention is a liquid crystal driving circuit that (i) finds a corrected video signal by carrying out, with respect to each of video signals supplied from a signal source, a correction in which a temporal change in each of the video signals is enhanced, and (ii) causes a voltage which varies in accordance with the corrected video signal to reverse in polarity at every predetermined reference unit, and (iii) applies the voltage to a data signal line, said liquid crystal driving circuit, including: a memory for storing a table, the table storing, in accordance with combinations of values of the video signals, correction values, respectively, the correction values in which the temporal changes of the video signals are enhanced; and a correcting circuit for (i) finding the correction value as the corrected video signal, in a case where the voltage has a predetermined polarity, and (ii), in a case where the voltage has a polarity opposite to the predetermined polarity, finding the corrected video signal by carrying out, with respect to the correction value selected from the table, a predetermined correcting operation in accordance with the polarity opposite to the predetermined polarity, with the use of a correction coefficient which is set based on properties of liquid crystal.

According to the arrangement, the liquid crystal driving circuit finds a corrected video signal by carrying out, with respect to a video signal supplied from the signal source, a correction in which a temporal change in each of the video signals is enhanced. A voltage, which varies depending on the corrected video signal thus found, reverses in polarity at every predetermined reference unit, for example, for every frame or for every line. Then, the voltage is applied to a data signal line. That is, liquid crystal is driven by reversal driving.

The memory in the liquid crystal driving circuit stores the table storing, in accordance with combinations of values of the video signals, correction values, respectively, in which correction values temporal changes of video signals are enhanced. The table stores, for example, correction values which are set in accordance with combinations of a value of a video signal of a previous frame and a value of a video signal of a current frame.

In the liquid crystal driving circuit, the correcting circuit finds a corrected video signal by carrying out, with respect to a correction value stored in the table, a correcting operation in accordance with a polarity of a voltage. That is, a correction value is initially selected from the table, independently of a polarity of a voltage.

Then, in a case where the voltage has a predetermined polarity (e.g., the positive polarity), the correcting circuit finds the correction value selected from the table, as it is, as a value of a corrected video signal. In contrast, in a case where the voltage has a polarity opposite to the predetermined polarity (e.g., the negative polarity), the correcting circuit carries out, with respect to the correction value selected from the table, a predetermined correcting operation with the use of correction coefficients set based on properties of liquid crystal in accordance with the opposite polarity.

Assume that the correcting circuit uses a correction value selected from the table, as it is, as a value of a corrected video signal, in a case where a voltage has the positive polarity. In this case, in a case where a voltage has the negative polarity, the correcting circuit finds a corrected video signal by carrying out, with respect to the correction value selected from the table, a correcting operation in accordance with the negative polarity, with the use of the correction coefficient. In this case, the table prepared in advance is one for the case of the positive polarity.

In contrast, assume that the correcting circuit uses a correction value selected from the table, as it is, as a value of a corrected video signal, in a case where a voltage has the negative polarity. In this case, in a case where a voltage has the positive polarity, the correcting circuit finds a corrected video signal by carrying out, with respect to the correction value selected from the table, a correcting operation in accordance with the positive polarity, with the use of the correction coefficient. In this case, the table prepared in advance is one for the case of the negative polarity.

As described above, the liquid crystal driving circuit can find an optimum corrected video signal in accordance with a polarity of a voltage, without preparing two different tables in accordance with a polarity of a voltage. This makes it possible to find, with less memory capacity, an optimum corrected video signal in accordance with a polarity of a voltage.

(Liquid Crystal Display Apparatus)

In order to attain the object, a liquid crystal display apparatus of the present invention includes any one of the aforementioned liquid crystal driving circuits. This arrangement makes it possible to provide a liquid crystal display apparatus that can, with less memory capacity, find an optimum corrected video signal in accordance with a polarity of a voltage to be applied to a data signal line.

Additional objects, features, and strengths of the present invention will be made clear by the description below. Further, the advantages of the present invention will be evident from the following explanation in reference to the drawings.

BRIEF DESCRIPTION OF DRAWINGS

FIG. 2(*a*) is a lookup table for a positive polarity. FIG. 2(*b*) is a lookup table for a negative polarity.

FIG. 3 is one example of a common lookup table.

FIG. 4 is a table showing one example of correction coefficients stored in a memory.

FIG. 5(*a*) and FIG. 5(*b*) are tables showing values of corrected video signals, which are found as a result of correcting operation utilizing a correction coefficient.

FIG. 6(*a*) is a table showing one example of correcting coefficients stored in the memory. FIG. 6(*b*) is a table showing another example of correcting coefficients stored in the memory.

EXPLANATION OF REFERENCE NUMERALS

Figure 1:
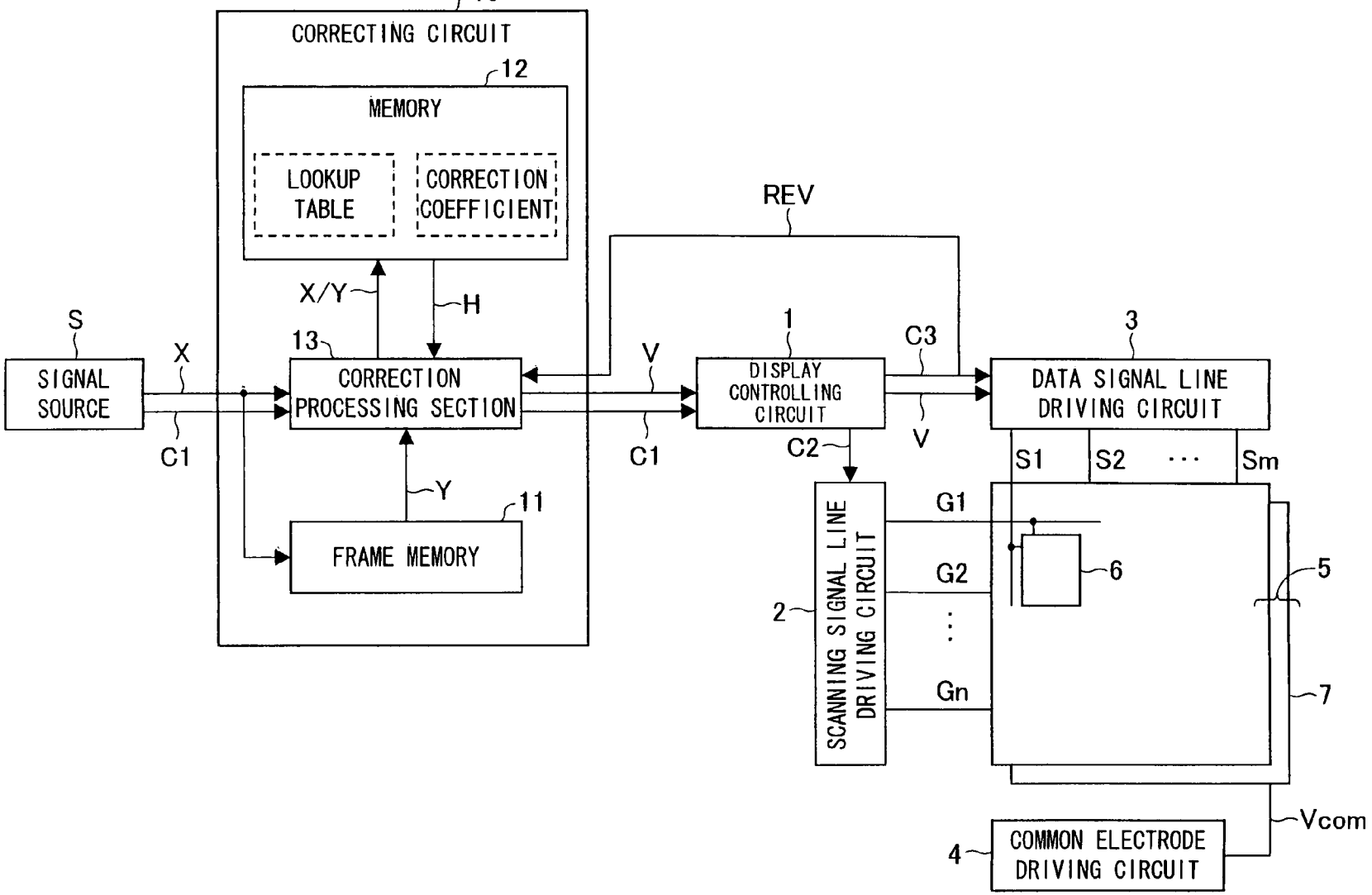
FIG. 1 is a block diagram illustrating an arrangement of a liquid crystal display apparatus of an embodiment of the present invention.

1 Display controlling circuit
2 Scanning signal line driving circuit
3 Data signal line driving circuit
4 Common electrode driving circuit
5 Pixel array
6 Pixel
7 Common electrode
10 Correcting circuit
11 Frame memory
12 Memory

BEST MODE FOR CARRYING OUT THE INVENTION

The following describes an embodiment of the present invention, with reference to FIGS. 1 through 7.

(Arrangement of Liquid Crystal Display Apparatus)

FIG. 1 is a block diagram illustrating an arrangement of a liquid crystal display apparatus of an embodiment of the present invention. The liquid crystal display apparatus, as illustrated in FIG. 1, includes a correcting circuit 10 (a liquid crystal driving circuit), a display controlling circuit 1, a scanning signal line driving circuit 2, a data signal line driving circuit 3, a common electrode driving circuit 4, and a pixel array 5. The liquid crystal display apparatus displays a screen image by carrying out line-reversal driving and overshoot driving. Assume hereinafter that the liquid crystal display apparatus illustrated in FIG. 1 is a normally-black type liquid crystal display apparatus.

In FIG. 1, a signal source S is provided outside the liquid crystal display apparatus, and supplies a video signal X and a control signal C1 to the liquid crystal display apparatus. The control signal C1 encompasses a clock signal CK, a horizontal synchronization signal HSYNC, a vertical synchronization signal VSYNC, etc. The correcting circuit 10 is provided for overshoot driving. The correcting circuit 10 finds a corrected video signal V, by carrying out a predetermined correcting process (to be described later in detail) in accordance with the control signal C1, with respect to the video signal X.

The pixel array 5 has an arrangement in which a liquid crystal substance is sandwiched between two glass substrates. Provided on one of the glass substrates are (m×n) pixels 6 (m and n are integer numbers of not less than one), scanning signal lines G1 through Gn, and data signal lines S1 through Sm. m pixels 6 are provided in a row direction; n pixels 6 are provided in a column direction. Each of the scanning signal lines G1 through Gn is connected to pixels 6 provided in a corresponding row. Each of the data signal lines S1 through Sm is connected to pixels 6 provided in a corresponding column. On the other one of the glass substrates, a common electrode 7 is provided so that the common electrode 7 faces each of the pixels 6.

The display controlling circuit 1 receives the corrected video signal V and the control signal C1 supplied from the signal source S via the correcting circuit 10. In accordance with the control signal C1, the display controlling circuit 1 supplies a control signal C2 to the scanning signal line driving circuit 2 and supplies a control signal C3 to the data signal line driving circuit 3. The control signal C2 contains a gate clock signal GCK, a gate start pulse GSP, etc. The control signal C3 contains a source clock signal SCK, a source start pulse SSP, a polarity reversal signal REV, etc. The display controlling circuit 1 supplies the corrected video signal V to the data signal line driving circuit 3, in sync with outputting of the control signal C3.

The scanning signal line driving circuit 2 sequentially and selectively activates the scanning signal lines G1 thorough Gn, in accordance with the control signal C2. The data signal line driving circuit 3 drives the data signal lines S1 through Sm, in accordance with the control signal C3 and the corrected video signal V. The common electrode driving circuit 4 applies a common electrode voltage Vcom to the common electrode 7.

The polarity reversal signal REV contained in the control signal C3 is a signal indicative of a polarity of a voltage to be applied to each of the data signal lines S1 through Sm. The polarity reversal signal REV is alternately switched, one line period by one line period (or every several line periods), between a High level and a Low level. In a case where the polarity reversal signal REV has a Low level, the data signal line driving circuit 3 applies, in accordance with the corrected video signal V, a voltage higher than the common electrode voltage Vcom (hereinafter, referred to as positive voltage) to each of the data signal lines S1 through Sm. In contrast, in a case where the polarity reversal signal REV has a High level, the data signal line driving circuit 3 applies, in accordance with the corrected video signal V, a voltage lower than the common electrode voltage Vcom (hereinafter, referred to as negative voltage) to each of the data signal lines S1 through Sm. Thus, the data signal line driving circuit 3 alternately switches, every certain line periods, the polarity of a voltage that varies according to the corrected video signal V, and applies the voltage to each of the data signal lines S1 through Sm. The liquid crystal display apparatus illustrated in FIG. 1 thus carries out the line-reversal driving.

In the liquid crystal display apparatus illustrated in FIG. 1, the common electrode driving circuit 4 can change a level of the common electrode voltage Vcom in accordance with the polarity reversal signal REV. Specifically, the common electrode driving circuit 4 can control the common electrode voltage Vcom to have a relatively low level in a case where the polarity reversal signal REV has a Low level, whereas the common electrode driving circuit 4 can control the common electrode voltage Vcom to have a relatively high level in a case where the polarity reversal signal REV has a High level.

The following describes in detail the correcting circuit 10. As illustrated in FIG. 1, the correcting circuit 10 includes a frame memory 11, a memory 12, and a correction processing section 13 (a correcting circuit). The frame memory 11 has a capacity for storing at least a video signal corresponding to one frame. The frame memory 11 stores at least the video signal X corresponding to one frame supplied from the signal source S.

The memory 12 stores a lookup table (a table) and a correction coefficient. The lookup table stores, in accordance with combinations of values of video signals, correction values, respectively, in which correction values temporal changes in video signals are enhanced. Specifically, the lookup table stores in advance correction values, each having one of 0 to 255, which are set in accordance with combinations of a value (0 to 255) of a video signal X of a current frame and a value (0 to 255) of a video signal Y of a previous frame, respectively.

The correction processing section 13 receives a video signal X of a current frame, a video signal Y of a previous frame, and a polarity reversal signal REV that is supplied from the display controlling circuit 1 to the data signal line driving circuit 3. The correction processing section 13 selects a correction value from the lookup table in accordance with the signals thus received. Then, the correction processing section 13 finds a corrected video signal by carrying out a predetermined correcting operation with respect to the selected correction value with the use of a correction coefficient that is prepared in advance.

(Lookup Tables for Positive and Negative Polarities)

In a case where an optimum correction value is selected from the lookup table in accordance with a polarity of a voltage to be applied to a data signal line, a technique is supposed in which the memory 12 stores in advance a lookup table for positive polarities and a lookup table for negative polarities (see FIG. 2(*a*) and FIG. 2(*b*)). FIG. 2(*a*) shows the lookup table for the positive polarities. FIG. 2(*b*) shows the lookup table for the negative polarities.

If these two lookup tables are used, the problem occurs that the memory 12 adversely requires a more capacity. Particularly, in a case where a liquid crystal display apparatus is incorporated into a mobile terminal device, such an increase in capacity of the memory 12 causes an increase in size of an IC. This ultimately causes a mobile terminal device to have a large size.

(One Example of Lookup Table)

In view of the problem, in the liquid crystal display apparatus of the present invention, the memory 12 stores in advance a single common lookup table independently of a polarity of a voltage to be applied to a data signal line. One example of the common lookup table is shown in a table of FIG. 3. FIG. 3 is a table showing one example of the common lookup table. As illustrated in FIG. 3, the common lookup table stores predetermined correction values in accordance with values of video signals of a current frame and values of video signals of a previous frame, respectively.

The memory 12 also stores in advance predetermined correction coefficients which are set based on properties of liquid crystal, respectively. One example of the correction coefficients is shown in FIG. 4. FIG. 4 is a table showing one example of the correcting coefficients stored in the memory 12. As shown in FIG. 4, the memory 12 stores nine correction coefficients in total, each of which is set in accordance with a current frame gradation range and a reference gradation range. The current frame gradation range means a range in which values of video signals (a gradation level) of a current frame fall. The reference gradation range means a range in which correction values to be selected from the lookup table fall.

(One Example of Correction Coefficient)

In the example shown in FIG. 4, the three ranges correspond to three ranges, respectively, obtained when a whole range of video signals is divided into three. Since a video signal has a maximum of 255 gradation, the video signal can take one value of 0 to 255. In the case of FIG. 4, a first range (a range 1) covers values from 0 to 20, approximately. A second range covers values from 20 to 220, approximately. A third range covers values from 220 to 255, approximately.

In the correction circuit 10, the correction processing section 13 selects from the common lookup table a correction value which is set in accordance with a combination of a value of a video signal of a current frame and a value of a video signal of a previous frame. Then, the correction processing section 13 obtains from the memory 12 a correction coefficient which is set in accordance with the value of the video signal of the previous frame and the correction value selected from the lookup table. Furthermore, with respect to the selected correction value, the correction processing section 13 carries out a correcting operation with the use of the correction coefficient thus obtained, in accordance with a polarity of a voltage to be applied to a data signal line. It is possible for the correction processing section 13 to recognize, from a polarity reversal signal REV, a polarity of a voltage to be applied to a data signal line.

The processing allows the correction processing section 13 to find a corrected video signal having a value which is set in accordance with a polarity of a voltage.

With reference to FIG. 5, the following describes a value of a corrected video signal that is obtained when a correction value selected from the lookup table shown in FIG. 3 is subjected to a correcting operation utilizing a correction coefficient shown in FIG. 4. FIG. 5 is a table showing values of corrected video signals, which are found as a result of the correcting operation utilizing a correction coefficient.

In the example of FIG. 5, the correction processing section 13 carries out a correcting operation in accordance with a polarity of a voltage to be applied to a data signal line. Assume that a correction value selected from the lookup table is represented by H; a value of a video signal of a previous frame is represented by Y; a correction coefficient is represented by a; a value of a corrected video signal is represented by V. In a case where the correction processing section 13 finds a corrected video signal in accordance with a positive polarity, the correction processing section 13 carries out a correcting operation represented by the following equation (1).

$$V=Y+(H-Y)\times a \qquad \text{Equation (1)}$$

In contrast, in a case where the correction processing section 13 finds a corrected video signal in accordance with a negative polarity, the correction processing section 13 carries out a correcting operation represented by the following equation (2).

$$V=Y-(H-Y)\times a \qquad \text{Equation (2)}$$

In the case of the positive polarity, the correction processing section 13 can dynamically obtains a lookup table shown in FIG. 5(*a*) based on the lookup table shown in FIG. 3., as a result of the correcting operation using the equation (1). In contrast, in the case of the negative polarity, the correction processing section 13 can dynamically obtains a lookup table shown in FIG. 5(*b*) based on the lookup table shown in FIG. 3., as a result of the correcting operation using the equation (2).

(Use of Linear Interpolation Operation)

More specifically, the correction processing section 13 carries out a predetermined linear interpolation operation, with the use of a correction coefficient in accordance with a range and adjacent another correction coefficient, thereby correcting a correction coefficient to be used in the correcting operation. With the arrangement, by merely preparing nine correction coefficients in advance, it is possible to use a correction coefficient in accordance with both a value of a video signal of a previous frame and a correction value selected from the lookup table. As such, it is possible to achieve substantially the same effect as that obtained in a case where all the correction coefficients in accordance with all the combinations of values of video signals are prepared in advance, while reducing a memory capacity required for storing correction coefficients.

It should be noted that, in a case where a correction coefficient in accordance with a combination which falls within the second range is selected, it is preferable to use the selected correction coefficient as it is, without the linear interpolation operation. This allows an improvement in quality of image display more appropriately.

When the correcting operation is carried out based on the equation (1), a decrease in voltage in each of the pixels generated due to the pull-in in the case of the positive polarity becomes close to a decrease in voltage in each of the pixels generated due to the pull-in in the case of the negative polarity. This makes it possible to suppress unevenness of brightness of the pixels, thereby improving the quality of image display. For example, this makes it possible to prevent stripes from being displayed when the line-reversal driving is carried out.

Similarly, when the correcting operation is carried out based on the equation (2), a decrease in voltage in each of the pixels generated due to the pull-in in the case of the negative polarity becomes close to a decrease in voltage in each of the pixels generated due to the pull-in in the case of the positive polarity. This makes it possible to suppress unevenness of brightness of the pixels, thereby improving the quality of image display. For example, this makes it possible to prevent stripes from being displayed when the line-reversal driving is carried out.

Note that a correction value, which is set in accordance with a sign of a difference value found when a value of a video signal of a previous frame is subtracted from the correction value, can be substituted for the correction value which is set merely in accordance with the a previous frame gradation range and a reference gradation range.

For example, nine (9) correction coefficients A through I (see FIG. 6(*a*)) are prepared, in a case where a correction value is set merely in accordance with a previous frame gradation range and a reference gradation range. As illustrated in FIG. 6(*b*), in contrast, only in a case where a previous frame gradation range is identical with a reference gradation range, a correction coefficient can be set in accordance with a sign of a difference value found when a value of a video signal of a previous frame is subtracted from a correction value. A is set as a correction coefficient with respect to a combination in the first previous frame gradation range, in a case where a difference value has a positive sign. Whereas A is set as a correction coefficient with respect to a combination of the first previous frame gradation range and the first reference gradation range in a case where the difference value has a positive sign, A' is set as a correction coefficient with respect to the combination in a case where the difference value has a negative sign. In this case, A and A' should meet A<A'. Likewise, whereas E is set as a correction coefficient with respect to a combination of the second previous frame gradation range and the second reference gradation range in a case where the difference value has a positive sign, E' is set as a correction coefficient with respect to the combination in a case where the difference value has a negative sign. In this case, E and E' should meet E<E'. Whereas I is set as a correction coefficient with respect to a combination in the third previous frame gradation range and the third reference gradation range in a case where the difference value has a positive sign, I' is set as a correction coefficient with respect to the combination in a case where the difference value has a negative sign. In this case, I and I' should meet I<I'.

(Relation Between Gradation and Pull-in Voltage)

In a case where the range in which values of the video signals fall is divided into first through third ranges in accordance with relations between the values and properties of liquid crystal, the correction coefficients are preferably set in accordance with (i) any one of first through third ranges into which a whole range in which a value of a video signal of a previous frame falls is divided and (ii) any one of first through third ranges into which a whole range in which the correction value falls is divided. The reason for this is described below with reference to FIG. 7.

Figure 7:
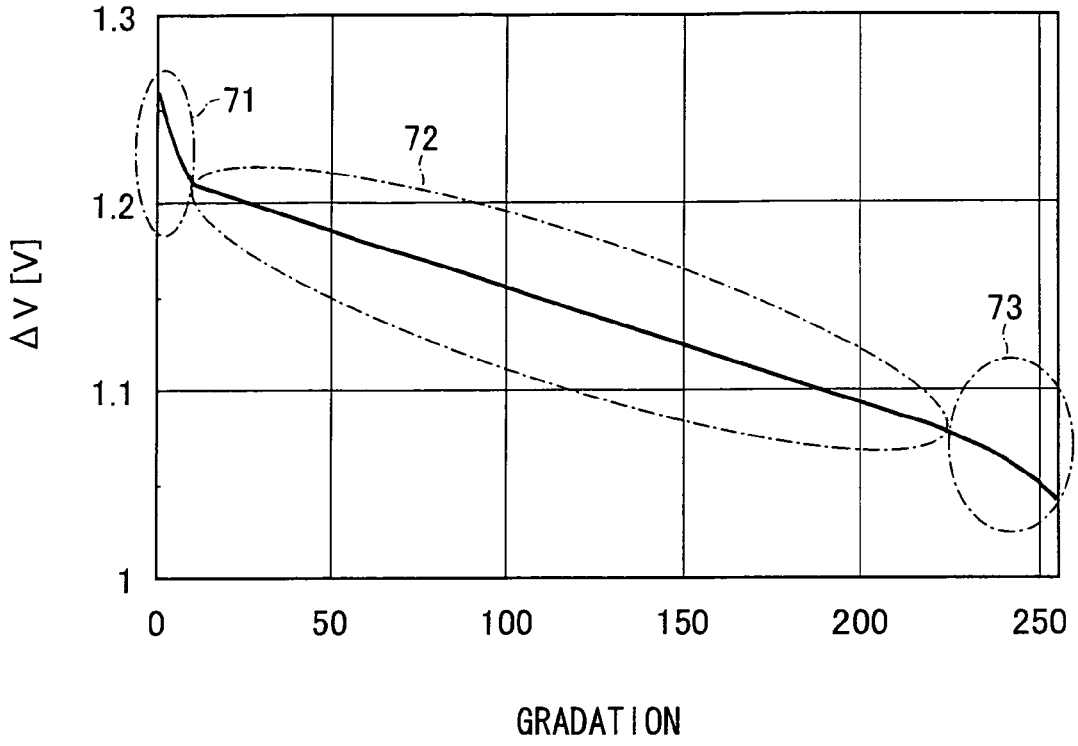
FIG. 7 is a graph showing a relation between a value of a video signal (a gradation level) and a voltage decrease (ΔV).

Properties of liquid crystal, especially, a pull-in voltage in a pixel varies according to a value of a video signal. It is known that, as shown in FIG. 7, a relation, between a voltage decrease and a value of a video signal, changes so as to have three phases in accordance with ranges in which values of video signals fall. FIG. 7 is a graph showing a relation between a possible value of a video signal (a gradation level) and a pull-in voltage (ΔV).

As illustrated in FIG. 7, in a range (the first range) from a minimum gradation value to a value corresponding to about 8% to 10% of a maximum gradation value, as shown in a range 71 in FIG. 7, a variation of ΔV with respect to a variation of the gradation (i) is larger than a variation of ΔV shown in an intermediate range 72 in FIG. 7, and (ii) is constant in the range 71.

In a range (the second range) from the value corresponding to about 8% to 10% of the maximum gradation value to a value corresponding to about 90% to 92% of the maximum gradation value, as shown in the range 72 in FIG. 7, a variation of ΔV with respect to a variation of the gradation (i) is smaller than those in the ranges 71 and 73, and (ii) is constant in the range 72.

In a range (the third range) from the value corresponding to about 90% to 92% of the maximum gradation value to a value of the maximum gradation value, as shown in the range 73 in FIG. 7, a variation of ΔV with respect to a variation of the gradation (i) is larger than that in the range 72, and (ii) is constant in the range 73.

As such, correction coefficients, which are in accordance with combinations in the ranges 71 through 73, are stored in the memory 12 in advance. Note that each of the correction coefficients is set so as to reflect the relation between the gradation and the ΔV (see FIG. 7). Specifically, a value of a correction coefficient for a combination in the range 71 is set smaller than a value of a correction coefficient for a combination in the range 72. This causes ΔVs to become equal to each other for respective gradations. In addition, the value of the correction coefficient for the combination in the range 72 is set larger than a value of a correction coefficient for a combination in the range 73. Use of such correction coefficients makes it possible for ΔVs to become close to each other for the respective gradations.

The present invention is not limited to the embodiment thus described. Namely, the same way can be varied in many ways within the scope of the following claims.

For example, the correcting circuit 10 can be arranged so that the correcting circuit 10, the display controlling circuit 1 and the data signal line driving circuit constitute a single liquid crystal driving circuit. In this case, the liquid crystal driving circuit of the present invention can be described as a liquid crystal driving circuit (i) finds a corrected video signal by carrying out, with respect to each of video signals supplied from the signal source S, a correction in which a temporal change in each of the video signals is enhanced, and (ii) causes a voltage which varies in accordance with the corrected video signal to reverse in polarity at every predetermined reference unit, and (iii) applies the voltage to each of the data signal lines S1 through Sm.

In addition, the liquid crystal driving circuit can be described as a liquid crystal driving circuit including the memory 12 for storing a table, the table storing, in accordance with combinations of values of the video signals, correction values, respectively, the correction values in which the temporal changes of the video signals are enhanced; and the correcting circuit 10 for finding the corrected video signal by carrying out, with respect to a correction value selected from the table, a predetermined correcting operation in accordance with the polarity of the voltage, with the use of a correction coefficient which is set based on properties of liquid crystal.

According to the arrangement, the liquid crystal driving circuit finds a corrected video signal by carrying out, with respect to a video signal supplied from the signal source S, a correction in which a temporal change in each of the video signals is enhanced. A voltage, which varies depending on the corrected video signal thus found, reverses in polarity at every predetermined reference unit, for example, for every frame or for every line. Then, the voltage is applied to each of the data signal lines S1 through Sm. That is, liquid crystal is driven by reversal driving. The correction makes it possible to perform overshoot driving.

The memory 12 in the liquid crystal driving circuit stores the lookup table storing, in accordance with combinations of values of the video signals, correction values, respectively, in which correction values temporal changes of video signals are enhanced. The lookup table stores, for example, correction values which are set in accordance with combinations of a value of a video signal of a previous frame and a value of a video signal of a current frame.

In the liquid crystal driving circuit, the correcting circuit 10 finds a corrected video signal, by carrying out a correcting operation, with respect to a correction value stored in the lookup table, in accordance with a polarity of a voltage to be applied to each of the data signal lines S1 through Sm. That is, a correction value is initially selected from the lookup table, independently of a polarity of a voltage.

Then, the correcting circuit 10 finds a corrected video signal, by carrying out, with respect to the correction value selected from the lookup table, the predetermined correcting operation with the use of correction coefficients which are based on properties of liquid crystal, in accordance with a polarity of a voltage. The correction coefficient can be a single common coefficient, or, alternatively, a value which varies depending on a value of a video signal.

In a case where a voltage has the positive polarity, the correcting circuit 10 carries out, with respect to the correction value selected from the lookup table, a correcting operation in accordance with the positive polarity, with the use of the correction coefficient (e.g., the correcting operation represented by the equation (1) above). The correcting circuit 10 thus finds a corrected video signal having a value suitable for the positive polarity. In contrast, in a case where a voltage has the negative polarity, the correcting circuit 10 carries out, with respect to the correction value selected from the lookup table, a correcting operation in accordance with the negative polarity, with the use of the correction coefficient (e.g., the correcting operation represented by the equation (2) above). The correcting circuit 10 thus finds a corrected video signal having a value suitable for the negative polarity.

As described above, the liquid crystal driving circuit can find an optimum corrected video signal in accordance with a polarity of a voltage, without preparing two different tables in accordance with a polarity of a voltage. This makes it possible to find, with less memory capacity, an optimum corrected video signal in accordance with a polarity of a voltage to be applied to each of the data signal lines S1 through Sm.

(Method for Driving Liquid Crystal)

The liquid crystal driving circuit of the present invention is a method for driving a liquid crystal driving circuit, in which: (i) a corrected video signal is found by carrying out, with respect to each of video signals supplied from the signal source S, a correction in which a temporal change in each of the video signals is enhanced, and (ii) a voltage which varies in accordance with the corrected video signal is reversed in polarity at every predetermined reference unit, and (iii) the voltage is applied to each of the data signal lines S1 through Sm, said method including: a selecting step of selecting the correction value from the table 12 storing, in accordance with combinations of values of the video signals, correction values, respectively, the correction values in which the temporal changes of the video signals are enhanced; and a correcting step of finding the corrected video signal by carrying out, with respect to a correction value selected from the table, a predetermined correcting operation in accordance with the polarity of the voltage, with the use of a correction coefficient which is set based on properties of liquid crystal.

(Correction Coefficient According to Value of Video Signal)

The correction coefficient is not limited to a specific one, provided that it is set in accordance with a video signal of a previous frame and the correction value. In this case, the correcting circuit carries out the correcting operation with the use of the correction coefficient which is set in accordance with the video signal of the previous frame and the correction value. This makes it possible to use a specific correction coefficient for every combination of a value of a video signal of a previous frame and a correction value selected from the table. As a result, it is possible to improve the quality of image display more finely.

(Correction Coefficient According to Combination of Ranges of Values of Video Signals)

The correction coefficient can be set in accordance with (i) a range in which a value of a video signal of a previous frame falls and (ii) a range in which the correction value falls. For example, in a case where a value of a video signal is in a range from 0 to 255, such a range is set so as to be divided into first through fourth ranges. In this case, for example, out of values of 0 to 255, the first range covers values from 0 to 80; the second range covers values from 81 to 120; the third range covers values from 121 to 200; the fourth range covers values from 201 to 255.

As such, in a case where a value of a video signal of a previous frame is 0 and a correction value selected from the lookup table is 125, the correcting circuit 10 carries out the correcting operation, which is carried out with respect to the correction value, with the use of a correction coefficient which is set in accordance with (i) the third range in which a value of a video signal of a previous frame falls and (ii) the third range in which a correction value falls.

This makes it possible to reduce the number of correction coefficients while the quality of image display is improved. As a result, this realizes a speedup of processing and a reduction in memory capacity.

(Three Divided Ranges)

Assume that the range in which values of the video signals fall is divided into first through third ranges in accordance with relations between the values and properties of liquid crystal. In this case, the correction coefficients can be set in accordance with (i) any one of first through third ranges into which a whole range in which a value of a video signal of a previous frame falls is divided and (ii) any one of first through third ranges into which a whole range in which the correction value falls is divided.

Properties of liquid crystal, especially, a pull-in voltage in a pixel varies according to a value of a video signal. It is known that a relation between a pull-in voltage and a value of a video signal changes so as to have three phases in accordance with ranges in which values of video signals fall.

In the arrangement above, it is preferable that the correction coefficients are set in accordance with (i) any one of first through third ranges into which a whole range in which a value of a video signal of a previous frame falls is divided and (ii) any one of first through third ranges into which a whole range in which the correction value falls is divided. That is, nine correction coefficients in total are prepared in advance.

This allows a reduction in the number of necessary correction coefficients, with minimum impairment of the quality of image display.

(Single Correction Coefficient)

The correcting circuit 10 can use in the correcting operation a same correction coefficient independently of the values of the video signals. This makes it possible to realize the simplest circuit and to minimize a necessary memory capacity.

(Correction Coefficient in Accordance with Difference Value)

Alternatively, each of the correction coefficients can be set, in advance, in accordance with a value found by subtracting a value of a video signal of a previous frame from a correction value selected from the lookup table. In this case, the correcting circuit 10 preferably uses in the correcting operation a correction coefficient which is set in accordance with the value found by subtracting the value of the video signal of the previous frame from the correction value.

Physical properties of liquid crystal response greatly vary between a case where the liquid crystal changes from a bright condition to a dark condition and a case where the liquid crystal changes from a dark condition to a bright condition. The physical properties such as a pull-in amount of a voltage to be applied to an electrode greatly vary between the cases.

According to the arrangement, each of the correction coefficients is set, in advance, in accordance with a range in which the value found by subtracting a value of a video signal of a previous frame from a correction value selected from the lookup table falls. As such, the correcting circuit 10 finds by subtracting a value of a video signal of a previous frame from a correction value selected from the lookup table, and uses in the correcting operation a correction coefficient in accordance with a range in which the value thus found falls.

Such a value thus found can be an index of an amount of change in brightness. Since the correcting circuit uses a correction coefficient in accordance with an index, it is possible to reduce an effect of the amount of change in brightness on the quality of image display.

(Correction Coefficient in Accordance with Range of Difference Values)

Each of the correction coefficients can be set, in advance, in accordance with a range in which the value found by subtracting the value of the video signal of the previous frame from the correction value falls. In this case, each of the correction coefficients is set, in advance, in accordance with a range in which the value found by subtracting a value of a video signal of a previous frame (a gradation level) from a correction value (a reference gradation level) selected from the lookup table falls. Accordingly, the correcting circuit 10 finds a value by subtracting a value of a video signal of a previous frame from a correction value selected from the lookup table, and uses in the correcting operation a correction coefficient in accordance with a range in which the value thus found falls.

(Linear Interpolation Operation for Finding Correction Coefficient)

The correcting circuit 10 can dynamically find a correction coefficient to be used in the correcting operation, by carrying out a linear interpolation operation with the use of (i) a correction coefficient selected in accordance with a range in which the difference value falls and (ii) adjacent another correction coefficient. This makes it possible to carry out, with fewer correction coefficients, a correcting operation whose accuracy is substantially the same as the accuracy of correcting operation in which correction coefficients are prepared in accordance with difference values, respectively. In addition, this makes it possible to further improve the quality of image display as compared to a case where a correction coefficient which is set in accordance with a range in which a difference value falls is used as it is in the correcting operation.

(Correction Coefficient in Accordance with Sign of Difference Value)

Each of the correction coefficients can be set, in advance, in accordance with a sign of the value found by subtracting the value of the video signal of the previous frame from the correction value. In this case, each of the correction coefficients is set, in advance, in accordance with a sign of the value found by subtracting the value of the video signal of the previous frame from the correction value selected from the lookup table. Accordingly, the correcting circuit 10 finds a value by subtracting a value of a video signal of a previous frame from a correction value selected from the lookup table, and uses in the correcting operation a correction coefficient in accordance with a sign (plus or minus) of the value thus found.

Predominant response properties of liquid crystal are those in a case where the liquid crystal changes from a bright condition to a dark condition and in a case where the liquid crystal changes from a dark condition to a bright condition. In view of this, a value of a correction coefficient used in a case where a difference value has a plus sign is set larger than that used in a case where the difference value has a negative sign. This makes it possible to minimize the number of necessary correction coefficients, with a certain degree of suppression of an effect of the amount of change in brightness on the quality of image display.

(Correction Coefficient in Accordance with Polarity of Voltage)

Each of the correction coefficients can be also set, in advance, in accordance with a polarity of a voltage to be applied to each of the data signal lines S1 through Sm. In this case, the correcting circuit 10 uses in the correcting operation a correction coefficient in accordance with the polarity of the voltage to be applied to each of the data signal lines S1 through Sm.

Electrical characteristics (parasitic capacitance etc.) inside or outside liquid crystal greatly vary between (i) a case where a polarity of a voltage to be applied to the liquid crystal is changed from positive to negative and (ii) a case where a polarity of a voltage to be applied to the liquid crystal is changed from negative to positive. This change can affect the quality of image display.

According to the arrangement, the correcting circuit 10 uses in the correcting operation a correction coefficient in accordance with a polarity of a voltage to be applied to each of the data signal lines S1 through Sm. This makes it possible to further suppress an effect caused by a change in polarity of a voltage to be applied to the liquid crystal, thereby further improving the quality of image display.

(Second Liquid Crystal Driving Circuit)

A liquid crystal driving circuit of the present invention can be a liquid crystal driving circuit that (i) finds a corrected video signal by carrying out, with respect to each of video signals supplied from the signal source S, a correction in which a temporal change in each of the video signals is enhanced, and (ii) causes a voltage which varies in accordance with the corrected video signal to reverse in polarity at every predetermined reference unit, and (iii) applies the voltage to each of the data signal lines S1 through Sm.

In this case, the liquid crystal driving circuit includes: the memory 12 for storing a table, the table storing, in accordance with combinations of values of the video signals, correction values, respectively, the correction values in which the temporal changes of the video signals are enhanced; and the correcting circuit 10 for (i) finding the correction value as the corrected video signal, in a case where the voltage has a predetermined polarity, and (ii), in a case where the voltage has a polarity opposite to the predetermined polarity, finding the corrected video signal by carrying out, with respect to the correction value selected from the table, a predetermined correcting operation in accordance with the polarity opposite to the predetermined polarity, with the use of a correction coefficient which is set based on properties of liquid crystal.

According to the arrangement, the liquid crystal driving circuit finds a corrected video signal, by carrying out, with respect to a video signal supplied from the signal source S, a correction in which a temporal change in each of the video signals is enhanced. A voltage, which varies depending on the corrected video signal thus found, reverses in polarity at every predetermined reference unit, for example, for every frame or for every line. Then, the voltage is applied to a data signal line. That is, liquid crystal is driven by reversal driving.

The memory 12 in the liquid crystal driving circuit stores the lookup table storing, in accordance with combinations of values of video signals, a correction value, respectively, in which correction values the temporal changes of the video signals are enhanced. The lookup table stores, for example, correction values which are set in accordance with combinations of a value of a video signal of a previous frame and a value of a video signal of a current frame.

In the liquid crystal driving circuit, the correcting circuit 10 finds a corrected video signal, by carrying out, with respect to a correction value stored in the lookup table, the correcting operation in accordance with a polarity of a voltage. That is, a correction value is initially selected from a single lookup table, independently of a polarity of a voltage to be applied to each of the data signal lines S1 through Sm.

Then, in a case where the voltage has a predetermined polarity (e.g., the positive polarity), the correcting circuit 10 finds the correction value selected from the lookup table, as it is, as a value of a corrected video signal. In contrast, in a case where the voltage has a polarity opposite to the predetermined polarity (e.g., the negative polarity), the correcting circuit 10 carries out, with respect to the correction value selected from the lookup table, a predetermined correcting operation with the use of correction coefficients set based on properties of liquid crystal in accordance with the opposite polarity.

Assume that the correcting circuit 10 uses a correction value selected from the lookup table, as it is, as a value of a corrected video signal, in a case where a voltage has the positive polarity. In this case, in a case where a voltage has the negative polarity, the correcting circuit 10 carries out, with respect to the correction value selected from the lookup table, a correcting operation in accordance with the negative polarity, with the use of the correction coefficient (e.g., the correcting operation represented by the equation (2) above). In this case, the table prepared in the memory 12 in advance is one for the case of the positive polarity.

In contrast, assume that the correcting circuit 10 uses a correction value selected from the lookup table, as it is, as a value of a corrected video signal, in a case where a voltage to be applied to each of the data signal lines S1 through Sm has a negative polarity. In this case, in a case where a voltage has the positive polarity, the correcting circuit 10 carries out, with respect to the correction value selected from the lookup table, a correcting operation in accordance with the positive polarity, with the use of the correction coefficient (e.g., the correcting operation represented by the equation (1) above). In this case, the table prepared in the memory 12 in advance is one for the case of the negative polarity.

As described above, the liquid crystal driving circuit can find an optimum corrected video signal in accordance with a polarity of a voltage, without preparing two lookup tables in accordance with a polarity of a voltage. This makes it possible to find, with less memory capacity, an optimum corrected video signal in accordance with a polarity of a voltage.

(Predictive Overshoot Operation)

The technical idea of the present invention is also applicable to a liquid crystal driving circuit that carries out overshoot driving based on a predictive overshoot operation. Specifically, a lookup table, which is used for finding a predictive video signal to be supplied to a frame memory, is prepared as a single common table that is used independently of a polarity of a voltage to be applied to each of the data signal lines S1 through Sm. Correcting operation, with the use of a correction coefficient, which is carried out in accordance with a polarity of a voltage (e.g., the correcting operation represented by the equation (1) or (2)), is carried out with respect to a predictive value selected from the lookup table for finding a predictive video signal. A predictive video signal which varies depending on a polarity of a voltage is thus found and supplied to the frame memory.

As described above, the liquid crystal driving circuit of the present invention includes the correcting circuit for finding a corrected video signal by carrying out a predetermined correcting operation in accordance with a polarity of a voltage to be applied to a data signal line, with the use of a correction coefficient which is set based on properties of liquid crystal, with respect to a correction value selected from the table storing, in accordance with combinations of values of the video signals, correction values, respectively, the correction values in which the temporal changes of the video signals are enhanced. This makes it possible to find, with less memory capacity, an optimum corrected video signal in accordance with a polarity of a voltage to be applied to a data signal lines.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention is applicable to various liquid crystal driving circuits that carry out driving such as line-reversal driving or frame-reversal driving in combination with overshoot driving, and is extensively applicable to liquid crystal driving circuits for mobile devices among others.

The invention claimed is:

1. A liquid crystal driving circuit that (i) finds a corrected video signal by carrying out, with respect to each of video signals supplied from a signal source, a correction in which a temporal change in each of the video signals is enhanced, and (ii) causes a voltage which varies in accordance with the corrected video signal to reverse in polarity at every predetermined reference unit, and (iii) applies the voltage to a data signal line, said liquid crystal driving circuit, comprising:

a memory for storing a table, the table storing, in accordance with combinations of values of the video signals, correction values, respectively, the correction values in which the temporal changes of the video signals are enhanced; and a correcting circuit for finding the corrected video signal by carrying out, with respect to a correction value selected from the table, a predetermined correcting operation in accordance with the polarity of the voltage, with the use of a correction coefficient which is set based on properties of liquid crystal, wherein the correcting circuit is configured to find a value of the corrected video signal by adding to, or subtracting from, a value of a video signal of the previous frame, a product of (i) the correction coefficient and (ii) a value found by subtracting the value of the video signal of a previous frame from the correction value.

2. The liquid crystal driving circuit as set forth in claim 1, wherein, the correcting circuit finds a value of the corrected video signal obtained in a case where the voltage has a positive polarity, by adding a product of (i) the correction coefficient and (ii) a value found by subtracting a value of a video signal of a previous frame from the correction value to the value of the video signal of the previous frame.

3. The liquid crystal driving circuit as set forth in claim 1, wherein, the correcting circuit finds a value of the corrected video signal obtained in a case where the voltage has a negative polarity, by subtracting, from a value of video signal of a previous frame, a product of (i) the correction coefficient and (ii) a value found by subtracting the value of the video signal of the previous frame from the correction value.

4. The liquid crystal driving circuit as set forth in claim 1, wherein:

the correction coefficients are set, in advance, in accordance with a video signal of a previous frame and the correction value; and the correcting circuit uses in the correcting operation the correction coefficient which is set in accordance with the video signal of the previous frame and the correction value.

5. The liquid crystal driving circuit as set forth in claim 4, wherein the correction coefficient is set in accordance with (i) a range in which values of video signals of a previous frame fall and (ii) a range in which the correction values fall.

6. The liquid crystal driving circuit as set forth in claim 5, wherein, in a case where the range in which values of the video signals fall is divided into first through third ranges in accordance with relations between the values and properties of liquid crystal, the correction coefficients are set in accordance with (i) any one of first through third ranges into which a whole range in which a value of a video signal of a previous frame falls is divided and (ii) any one of first through third ranges into which a whole range in which the correction value falls is divided.

7. The liquid crystal driving circuit as set forth in claim 6, wherein:

the first range covers values from a minimum value of the video signals to a value corresponding to about 8% to 10% of a maximum value of the video signals;

the second range covers values from a value larger by one than a maximum value of the first range to a value corresponding to about 90% to 92% of the maximum value of the video signals; and the third range covers values from a value larger by one than a maximum value of the second range to the maximum value of the video signals.

8. The liquid crystal driving circuit as set forth in claim 1, wherein the correcting circuit uses in the correcting operation a same correction coefficient independently of the values of the video signals.

9. The liquid crystal driving circuit as set forth in claim 1, wherein:

each of the correction coefficients is set, in advance, in accordance with a value found by subtracting a value of a video signal of a previous frame from a correction value; and the correcting circuit uses in the correcting operation the correction coefficient which is set in accordance with the value found by subtracting the value of the video signal of the previous frame from the correction value.

10. The liquid crystal driving circuit as set forth in claim 9, wherein said each of the correction coefficients is set, in advance, in accordance with a range in which the value found by subtracting the value of the video signal of the previous frame from the correction value falls.

11. The liquid crystal driving circuit as set forth in claim 10, wherein said each of the correction coefficients is set, in advance, in accordance with a sign of the value found by subtracting the value of the video signal of the previous frame from the correction value.

12. The liquid crystal driving circuit as set forth in claim 1, wherein:

each of the correction coefficients is also set, in advance, in accordance with the polarity of the voltage; and the correcting circuit uses in the correcting operation a correction coefficient in accordance with the polarity of the voltage.

13. A liquid crystal driving circuit that (i) finds a corrected video signal by carrying out, with respect to each of video signals supplied from a signal source, a correction in which a temporal change in each of the video signals is enhanced, and (ii) causes a voltage which varies in accordance with the corrected video signal to reverse in polarity at every predetermined reference unit, and (iii) applies the voltage to a data signal line, said liquid crystal driving circuit, comprising:

a memory for storing a table, the table storing, in accordance with combinations of values of the video signals, correction values, respectively, the correction values in which the temporal changes of the video signals are enhanced; and a correcting circuit for (i) finding the correction value as the corrected video signal, in a case where the voltage has a predetermined polarity, and (ii), in a case where the voltage has a polarity opposite to the predetermined polarity, finding the corrected video signal by carrying out, with respect to the correction value selected from the table, a predetermined correcting operation in accordance with the polarity opposite to the predetermined polarity, with the use of a correction coefficient which is set based on properties of liquid crystal, wherein the correcting circuit is configured to find a value of the corrected video signal by adding to, or subtracting from, a value of a video signal of the previous frame, a product of (i) the correction coefficient and (ii) a value found by subtracting the value of the video signal of a previous frame from the correction value.

14. A liquid crystal display apparatus comprising a liquid crystal driving circuit as set forth in claim 1.

15. A method for driving a liquid crystal driving circuit, in which: (i) a corrected video signal is found by carrying out, with respect to each of video signals supplied from a signal source, a correction in which a temporal change in each of the video signals is enhanced, and (ii) a voltage which varies in accordance with the corrected video signal is reversed in polarity at every predetermined reference unit, and (iii) the voltage is applied to a data signal line, said method comprising:

a selecting step of selecting the correction value from a table storing, in accordance with combinations of values of the video signals, correction values, respectively, the correction values in which the temporal changes of the video signals are enhanced; and a correcting step of finding the corrected video signal by carrying out, with respect to a correction value selected from the table, a predetermined correcting operation in accordance with the polarity of the voltage, with the use of a correction coefficient which is set based on properties of liquid crystal, wherein the correcting step includes finding a value of the corrected video signal by adding to, or subtracting from, a value of a video signal of the previous frame, a product of (i) the correction coefficient and (ii) a value found by subtracting the value of the video signal of a previous frame from the correction value.

* * * * *